United States Patent [19]

Koehler

[11] Patent Number: 4,744,779

[45] Date of Patent: May 17, 1988

[54] OUTBOARD MOTOR CAVITATION PLATE EXTENSION

[75] Inventor: Kenneth E. Koehler, Harlingen, Tex.

[73] Assignee: Ferrero & Wepfer, Harlingen, Tex. ; a part interest

[21] Appl. No.: 938,077

[22] Filed: Dec. 4, 1986

[51] Int. Cl.[4] ..... B63H 1/18

[52] U.S. Cl. ..... 440/900; 440/66; 440/76

[58] Field of Search ..... 440/65–71, 440/76, 88, 900; 114/271, 274, 288

[56] References Cited

U.S. PATENT DOCUMENTS

| | | | |
|---|---|---|---|
| 904,313 | 11/1908 | Davis | 440/66 |
| 1,226,400 | 5/1917 | Smith | 440/66 X |
| 2,111,325 | 3/1938 | Linthwaite | 440/66 |
| 2,747,819 | 5/1956 | Aldrich et al. | 440/900 |
| 2,791,196 | 5/1957 | Strang | 440/65 |
| 2,860,594 | 11/1958 | Kiekhaefer | 440/66 |
| 2,963,000 | 12/1960 | Fester | 440/71 |
| 3,433,195 | 3/1969 | Poole | 114/274 |
| 3,469,557 | 9/1969 | Wollard | 440/69 |
| 3,768,432 | 10/1973 | Spaulding | 440/66 |
| 3,931,828 | 1/1976 | Lawler | 440/88 X |
| 4,070,983 | 1/1978 | Randall . | |
| 4,205,618 | 6/1980 | Olsson | 440/66 X |
| 4,235,183 | 11/1980 | Evinrude | 440/71 |
| 4,323,355 | 4/1982 | Kondo | 440/900 X |
| 4,445,452 | 5/1984 | Loch | 440/66 X |
| 4,487,152 | 12/1984 | Larson | 440/66 X |

*Primary Examiner*—Joseph F. Peters, Jr.
*Assistant Examiner*—Paul E. Salmon
*Attorney, Agent, or Firm*—Fleit, Jacobson, Cohn & Price

[57] ABSTRACT

A horizontally elongated panel constructed of dielectric material is provided including front and rear ends. The panel is provided with a longitudinal slot closed at its forward end and open at its rear end and the front end of the panel is forwardly and upwardly curved. The lower unit of an outboard motor is forwardly, snugly seatable within the slot and the panel is mountable from the opposite side outwardly projecting cavitation plate portions of the lower unit. The panel functions as a water confining panel for disposition substantially at the surface of an associated body of water for sealing the area in which the outboard motor propeller turns against the entrance of ambient air into the water from above the water surface.

10 Claims, 2 Drawing Sheets

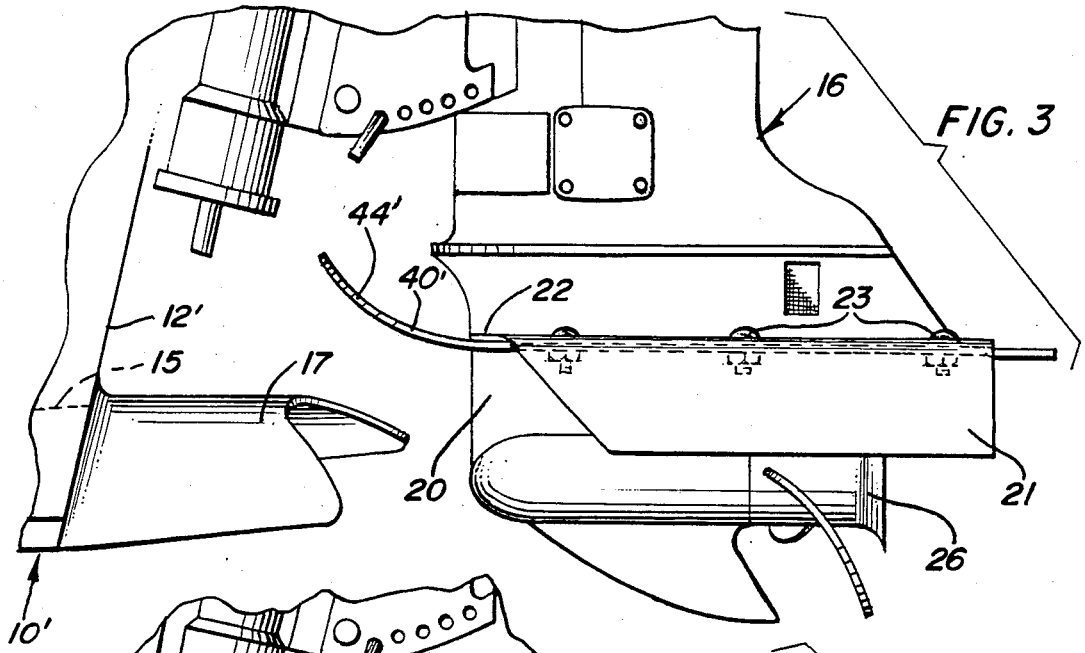
FIG. 3
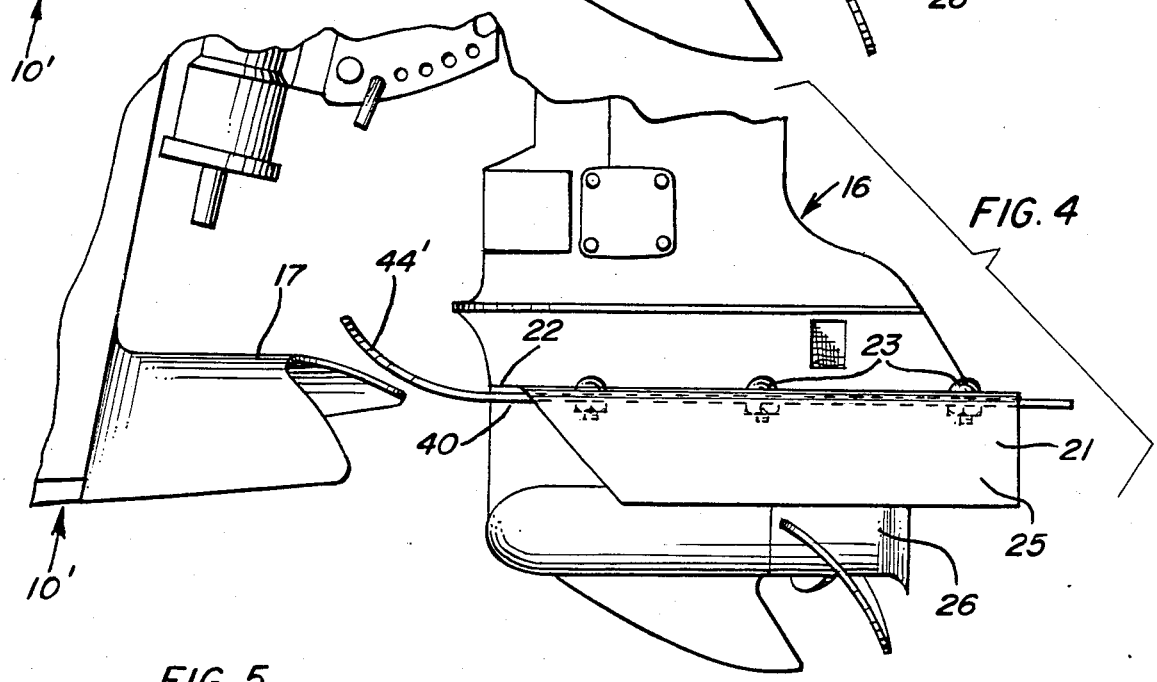
FIG. 4
FIG. 5
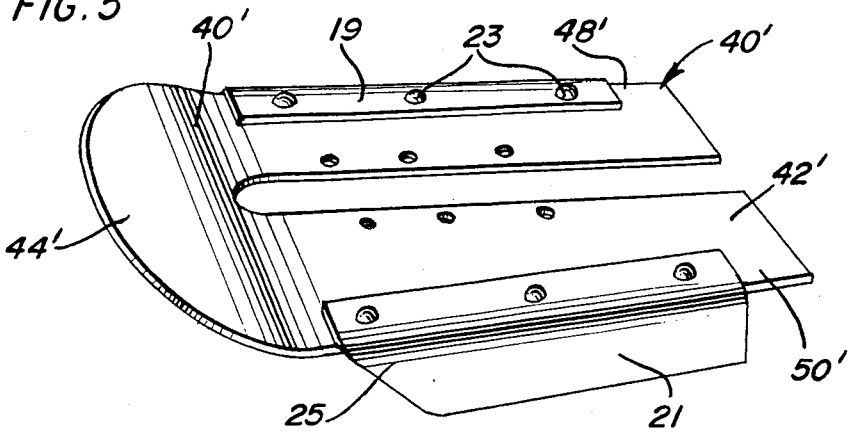

OUTBOARD MOTOR CAVITATION PLATE EXTENSION

BACKGROUND OF THE INVENTION

This invention relates to a horizontally outwardly projecting extension for an outboard motor cavitation plate, but is not specifically designed to alter the high speed running attitude of an associates boat. Rather, the invention is designed specifically to enable an outboard motor mounted upon the rear of a light weight fishing boat to be elevated relative to that boat appreciably above the usual height adjusted position of an outboard motor. The cavitation plate extension is designed to run substantially at or even slightly above the ambient water level. In this manner, the lower unit of a light weight fishing boat projects only minimally below the lower surfaces of the associates boat hull and the boat may be operated in extremely shoal waters.

DESCRIPTION OF RELATED ART

Various different forms of cavitation plate extensions and boat stabilizers including some of the general structural and operational features of the instant invention heretofore have been provided. Examples of these previously known devices are disclosed in U.S. Pat. Nos. 904,313; 1,226,400; 2,111,325; 2,791,196; 2,963,000; 3,768,432; 4,205,618; 4,445,452; and 4,487,152. However, these previously known devices do not include the operational features of the instant invention which particularly well adapt it for use as an attachment enabling extremely shoal draft running of a conventional outboard motor.

SUMMARY OF THE INVENTION

The cavitation plate extension of the instant invention is of a size to overlie a considerable plan area of the surface of the water immediately over the running position of the propeller of the associated outboard motor. The cavitation plate extension is not designed to run below the surface of the water and to exert an upward force on the associated outboard motor to thereby depress the bow of the associated boat, nor is the cavitation plate extension designed to exert a downward force on the associated outboard motor. Further, the cavitation plate extension is not designed to plane over the surface of a body of water in a positive inclined attitude such as to exert an upward force on the associated outboard motor. Rather, the cavitation plate extension is designed to move across the surface of a body of water in a substantially horizontal attitude and with only the forward marginal portion of the cavitation plate extension being slightly forwardly and upwardly curved in order to act, only, as structure to "smooth-out" the water immediately forward of the main body portion of the cavitation plate disposed over the associated outboard motor propeller.

By utilization of the cavitation plate extension, the water immediately about and above the outboard motor propeller operating at an extremely shoal depth is prevented from being upwardly displaced by the action of the propeller thereon. Such upward displacement of water in the area of the propeller would, of course, cause cavitation. In addition, the cavitation plate extension "seals" the surface of the body of water immediately above the associated outboard motor propeller against the introduction of air into the water immediately adjacent the propeller.

The main object of this invention is to provide an outboard motor cavitation plate extension specifically designed to enable an otherwise conventional outboard motor to operate in extreme shoal waters.

Yet another object of this invention is to provide an outboard motor cavitation plate extension in accordance with the proceeding objects and which will not create appreciable drag in the form of resistance against forward movement of the cavitation plate relative to the associated body of water.

Still another important object of this invention is to provide a cavitation plate extension which will form "seal" against the admission of ambient air into the water immediately adjacent associated outboard motor propeller.

Another object of this invention is to provide a cavitation plate extension which will function to ensure a proper supply of ambient water to the water pump intake of an associated outboard motor.

Still another important object of this invention is to provide a cavitation plate extension which may be mounted on an associated outboard motor cavitation plate independent plate of fasteners secured directly to or through the outboard motor cavitation plate.

Another important object of this invention is to provide a cavitation plate extension constructed of dielectric material whereby the designed corrosion inhibiting structure provided on the outboard motor will be maintained effective.

Yet another object of this invention is to provide a cavitation plate extension which, in addition to enabling higher running of an associated outboard motor lower unit in a body of water and thus reducing the resistance to movement of the lower unit through the water, also will function to depress the water level, at least slightly, at the forward marginal portion of the lower unit to further reduce the frictional resistance to forward movement of the lower unit through an associated body of water.

Yet another object of this invention is to provide an outboard motor cavitation plate extension specifically designed for use in conjunction with an outboard motor mounted on the transom of a boat hull defining a downwardly opening tunnel immediately forward of the outboard motor lower unit.

Still another object of this invention is to provide a cavitation plate extension and mounting structure therefore which will not interfere with the designed electrolytic corrosion control of the associated outboard motor.

A final object of this invention to be specifically enumerated herein is to provide a cavitation plate extension in accordance with the preceeding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a side elevational similar to FIG. 1 but illustrating the outboard motor and attendant cavitation plate extension operatively associated with a boat hull having a downwardly and rearwardly opening tunnel immediately forward of the associated outboard motor and with the outboard motor in an extremely elevated position;

FIG. 4 is a side elevational view similar to FIG. 3 and illustrating a slightly lower position of the outboard motor and tendent cavitation plate extension used when operating in rough water;

FIG. 5 is a perspective view of the cavitation plate extension illustrated in FIGS. 3 and 4;

DESCRIPTION OF THE PREFERRED EMBODIMENTS

Figure 1:
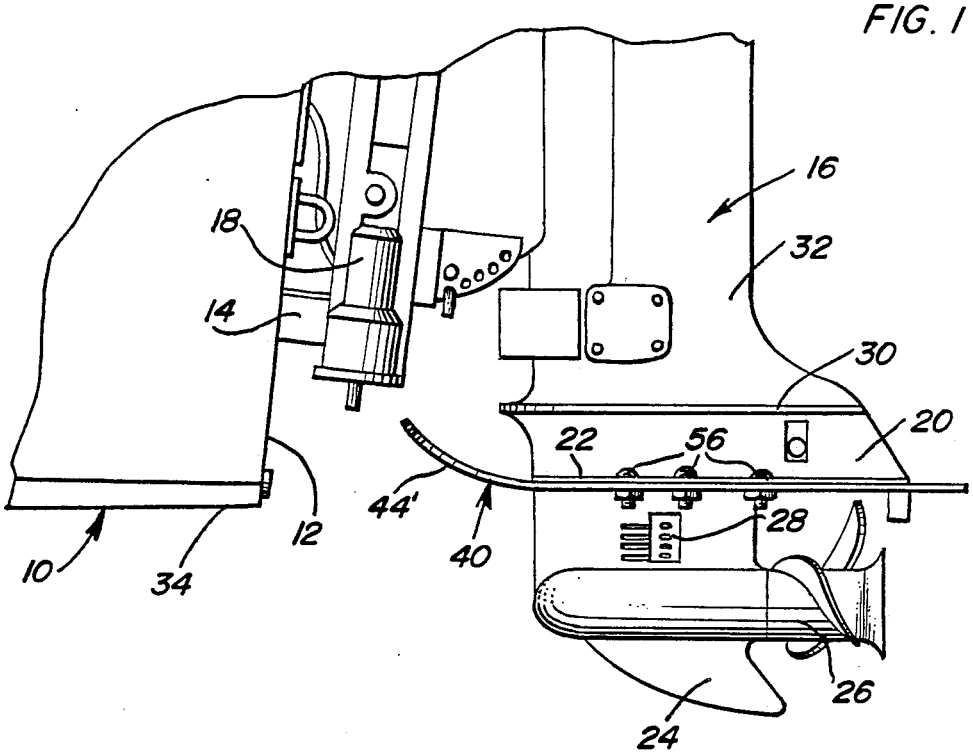
FIG. 1 is a fragmentary side elevational view of the rear portion of a planing-type boat hull with a vertically adjustable outboard motor mounted therefrom and equipped with the cavitation plate extension of the instant invention.
Figure 2:
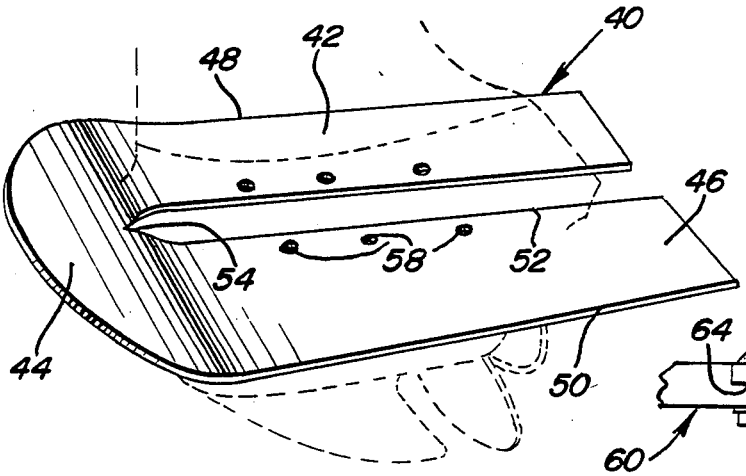
FIG. 2 is a perspective view of the cavitation plate extension.

Referring now more specifically to the drawings and to FIGS. 1 and 2 in particular, the numeral 10 generally designates a conventional form of planing boat hull including a transom 12 and an outboard motor mount 14 supported from the transom and mounting an outboard motor referred to in general by the reference numeral 16 therefrom for vertical adjustment relative to the transom 12 through the utilization of adjusting structure 18 comprising a part of the mount 14.

The outboard motor 16 is of conventional design and includes a lower unit 20 including opposite side cavitation plate portions 22, a lower protective skeg 24 and a driven rotary propeller 26 disposed below the opposite side cavitation plate portions 22.

The lower unit 20 additionally includes intake structure 28 for the water pump of the motor 16 and the motor 16 is designed to run at a depth with the ambient water level approximately in the area of the horizontal break 30 between the lower unit 20 and the leg 32 from whose lower end the lower unit 20 is supported.

The foregoing comprises a description of a conventional outboard motor installation on the transom of a reasonably light weight planing hull.

In some locations light weight fishing boats equipped with outboard motors are operated in extremely shoal waters. If an outboard motor such as that indicated at 16 is conventionally mounted on a transom such at the transom 12 with the horizontal break 30 disposed generally horizontally aligned with or slightly below the bottom 34 of the boat 10, the cavitation plate portions 22 are disposed beneath the surface of the ambient water and thus adequately serve to prevent cavitation of the water adjacent the propeller 26. If, on the other hand, the mount 14 is utilized to upwardly adjust the outboard motor 16 to a level approaching that illustrated in FIG. 1 wherein the cavitation plate portions 22 are closely adjacent or even above the bottom 34, the cavitation plate portions 22 are not operable to prevent cavitation of the ambient water adjacent the propeller 26. However, such upward vertical adjustment of the outboard motor 16 and even further upward adjustment thereof in some instances is desired when the boat or hull 10 is operating in extremely shoal waters. In addition, it is extremely important that the water inlet structure 28 be insured a supply of ambient water independent of excessive quantities of air bubbles therein. The intake of air and water at the intake structure 28 for the water pump of the motor 16 can cause pitting of various internal metallic portions of the water pump (not shown). However, if the intake structure 28 is provided with water without large quantities of air therein the water pump of the outboard motor 16 may be expected to enjoy a long lifetime of operation.

The cavitation plate extension or attachment of the instant invention is referred to in general by the reference numeral 40 and comprises a generally horizontal plate or panel 42 having front and rear margins 44 and 46 as well as generally longitudinally straight and rearwardly convergent opposite side longitudinal margins 48 and 50. The plate 42 has a longitudinal slot 52 formed therein and the slot 52 opens rearwardly through the rear margin 46 and terminates forwardly at a pointed terminus 54 to conform to leading edge of motors lower unit spaced rearward of the front margin 44. The front margin 44 is forwardly convexly rounded in plan shape (see FIG. 2) and is forwardly and upwardly curved, see FIG. 1.

The attachment 40 is secured to the cavitation plate portions 22 on opposite sides of the lower unit 20 through the utilization of nylon or other plastic material fasteners 56 secured through apertures 58 in the plate portions 22 and also those portions of the plate 42 disposed on opposite sides of the slot 52. Further, the attachment 40 is constructed of fiberglass or other dielectric material whereby the control of corrosion, as a result of electrolysis, built into the outboard motor 16 by the manufacturer thereof will not be altered.

The preferabl minimum length of the plate or panel 42 will be 24 inches and the minimum width thereof will be 23 inches. However, with smaller horsepower motors the width may be reduced to approximately 18 inches and the length may be reduced to approximately 18 inches. In essence, the absolute minimum size of the plate or panel 42 will be $2\frac{1}{4}$ sq. feet in plan area. It is to be noted that the attachment is to be used in conjunction with a light weight or reasonably light weight boat utilized for fishing purposes and equipped with an outboard motor of sufficient horsepower to at least plane the associated boat. Heavier boats and boats powered by low horsepower outboard motors do not benefit to the same extent from utilization of the attachment 40. Rather, light weight outboard motor powered boats which are capable of planing at medium through high speeds are those boats for which the instant invention has been specifically designed.

With attention now invited more specifically FIGS. 3 and 4, it may be seen that the outboard motor 16 is mounted upon the transom 12′ of a boat or hull 10′ having a central longitudinal downwardly and rearwardly opening tunnel 15 and that the transom 12′ includes a downwardly opening transversely arched rearward extension 17 of the tunnel 15. The extension 17 extends rearward to a point closely adjacent the lower unit 20 and in this installation the outboard motor 16 may be vertically adjusted upwardly from the position thereof illustrated in FIG. 1 to a position with the cavitation plate portions 22 thereof spaced appreciably above the uppermost extremity of the tunnel extension 17. However, the attachment 40', mounted from the cavitation plate portions 22, includes opposite side margin mounted angle members 19 and 21 supported from corresponding sides of the panel 42' through the utilization of nylon or other plastic fasteners 23. These angle members, as are the margins 48' and 50', are slightly rearwardly convergent and the depending flange portions 25 thereof maintain the integrity of the transversely humped flow of water exiting rearwardly from the extension 17 to thereby ensure against cavitation of the water adjacent the propeller 26. The upwardly adjusted position of the outboard motor 16' in FIG. 3 is used when the boat or hull 10' is operating on relatively smooth, shoal waters. If, however, a storm or high wind should develop and the water become rough, the outboard motor 16' mounted from the boat or hull 10' may be lowered to the position thereof illustrated in FIG. 4.

The forwardly and upwardly curving front margin 44' of the panel 40' ensures that all water exiting rearward from the tunnel extension 17 will be contained beneath the panel 40'. This, in conjunction with the angle members 19 and 21 ensures that the water immediately adjacent and about the associated propeller 26 will not experience cavitation.

Figure 6:
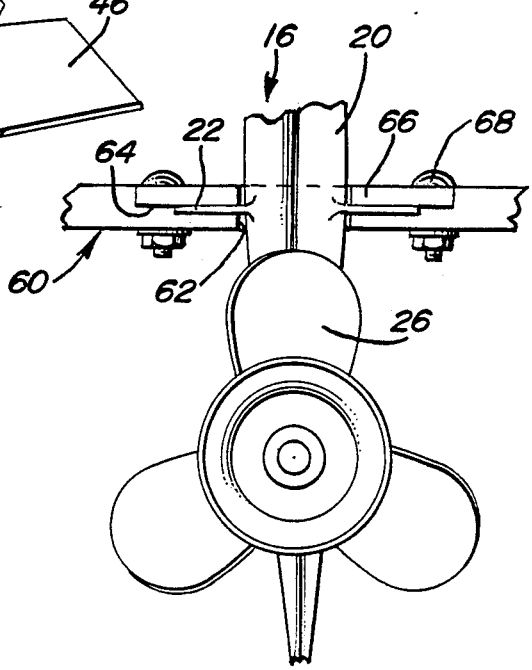
FIG. 6 is a rear elevational view fragmentarily illustrating a modified form of cavitation plate extension clamp supported from the associated outboard motor cavitation plate.
Figure 7:
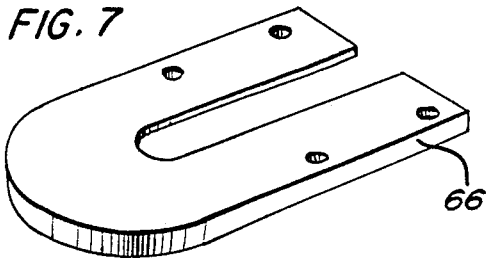
FIG. 7 is a perspective view of the clamp plate utilized in conjunction with the modified form of cavitation plate extension illustrated in FIG. 6.

With attention invited now more specifically to FIGS. 6 and 7 of the drawings, there may be seen a modified form of attachment referred to in general by the reference numeral 60. The attachment 60 is substantially identical to the attachment 40, except that the under surfaces thereof on opposite sides of the slot 62 corresponding to the slot 52 are relieved as at 64. In addition, the attachment 60 includes a U-shaped plate 66 which overlays the attachment 60 and serves as a clamp plate operative in conjunction with the attachment 60 and nylon fasteners 68 to clamp support the attachment 60 on the lower unit 20.

The fasteners 68 are spaced outward of the remote sides of the cavitation plate portions 22 and, accordingly, no permanent modifications of the lower unit 20 are required for mounting the attachment 60 therefrom. Of course, the attachment 60 also may include angle members corresponding to the angle members 19 and 21, if desired.

The foregoing is considered as illustrative only of the principles of the invention. Further, since numerous modifications will readily occur to those skilled in the art, it is not desired to limit the invention to the exact construction and operation shown and described, and accordingly, all suitable modifications and equivalents may be resorted to, falling within the scope of the invention.

What is claimed is:

1. In combination with a transom equipped boat hull to be used in shoal waters and including a propeller equipped outdrive of sufficient horse power to drive said hull at planing speeds and above and wherein the outdrive is disposed rearwardly of the transom of said hull and equipped with a depending lower unit and further wherein the outdrive is supported from the hull in an upwardly adjusted position relative to the conventional height adjusted position of an outdrive thereon, so as to reduce the draft of the hull as determined by the propeller equipped outdrive, said hull including a downwardly facing longitudinally extending planing surface portion terminating rearwardly a spaced distance forward of said lower unit and defining a longitudinal downwardly and rearwardly opening narrow tunnel defining an upper extremity and longitudinally aligned with said lower unit, said lower unit including opposite side outwardly projecting cavitation plate portions spaced closely above said propeller and disposed at an elevation no lower than the upper extremity of said tunnel, a water confining lower unit attachment including a generally horizontal panel having front and rear margins as well as opposite side margins and further having a longitudinal slot formed therein centrally intermediate said opposite side margins, said slot opening rearwardly through said rear margin and terminating forwardly rearwardly of said front margin, said panel being positioned in lapped relation with said cavitation plate portions and with said lower unit snugly received in and at least substantially forwardly seated in said slot, means mounting said horizontal panel from said plate portions, said horizontal panel including a maximum width front margin portion which is at least slightly forwardly and upwardly curved, said hull including a transversely arched and downwardly opening rearward extension of said tunnel projecting rearwardly of said transom and terminating rearwardly a spaced distance forward of said lower unit.

2. The boat hull, outdrive and attachment combination of claim 1, wherein said front margin is disposed entirely forward of said slot.

3. The combination of claim 2, wherein said panel is constructed of fiberglass.

4. The boat hull, outdrive and attachment combination of claim 1, wherein said opposite side margins are generally longitudinally straight and rearwardly convergent rearward of said forward maximum transverse dimension portion.

5. The combination of claim 4, wherein said opposite side margins include depending flange portions longitudinally therealong.

6. The boat hull, outdrive and attachment combination of claim 1, wherein said means mounting said horizontal panel from said plate portions comprise fasteners constructed of dielectric material and said panel is constructed of dielectric material.

7. The boat hull, outdrive and attachment combination of claim 1, wherein said means mounting said panel from said plate portions comprises a generally U-shaped clamp plate, said plate portions being disposed between said clamp plate and portions of said panel defining said slot, and fasteners secured through said panel and said clamp plate outward of said horizontal plate portions.

8. The combination of claim 7, wherein said panel, plate portions and fasteners are constructed of dielectric materials.

9. The boat hull, outdrive and attachment combination of claim 1, wherein said lower unit includes outboard motor water pump water intake structure opening laterally outwardly of at least one side thereof a spaced distance below said panel and above the axis of rotation of said propeller.

10. The boat hull, outboard motor and attachment combination of claim 1 wherein siad opposite side margins include depending flange portions extending longitudinally therealong.

* * * * *